United States Patent [19]

Konishi et al.

[11] Patent Number: 4,912,993

[45] Date of Patent: Apr. 3, 1990

[54] ENGINE STARTER

[75] Inventors: Keiichi Konishi; Akira Takami, both of Himeji, Japan

[73] Assignee: Mitsubishi Denki Kabushiki Kaisha, Japan

[21] Appl. No.: 294,996

[22] PCT Filed: Feb. 9, 1988

[86] PCT No.: PCT/JP88/00121

§ 371 Date: Oct. 6, 1988

§ 102(e) Date: Oct. 6, 1988

[87] PCT Pub. No.: WO88/06238

PCT Pub. Date: Aug. 25, 1988

[30] Foreign Application Priority Data

Feb. 10, 1987 [JP] Japan ..... 62-28626

[51] Int. Cl.[4] ..... F02N 15/00

[52] U.S. Cl. ..... 74/7 E; 74/437; 74/7 A; 475/17; 475/149; 475/254; 475/904

[58] Field of Search ..... 74/7 E, 7 A, 793, 802, 74/804, 437 X

[56] References Cited

U.S. PATENT DOCUMENTS

| | | | |
|---|---|---|---|
| 4,472,984 | 9/1984 | Cook | 74/793 X |
| 4,495,905 | 1/1985 | Morishita et al. | 123/179 F |
| 4,635,489 | 1/1987 | Imamura et al. | 74/7 E |
| 4,671,125 | 6/1987 | Yabunaka | 74/7 E |
| 4,685,348 | 8/1987 | Takami | 74/437 |
| 4,765,195 | 8/1988 | Takami | 74/793 X |

FOREIGN PATENT DOCUMENTS

| | | | |
|---|---|---|---|
| 2909783 | 9/1980 | Fed. Rep. of Germany | 74/793 |
| 502159 | 4/1976 | U.S.S.R. | 74/437 |
| 1199145 | 7/1970 | United Kingdom . | |

*Primary Examiner*—Philip C. Kannan

*Attorney, Agent, or Firm*—Leydig, Voit & Mayer

[57] ABSTRACT

A starter includes a speed changing mechanism for transmitting rotational force of an electric motor to a pinion gear capable of being brought into or out of engagement with a ring gear of an engine. The speed changing mechanism includes a geared stepless speed changer. A speed reduction ratio is controlled responsive to a load change by means of an input shaft, an output shaft, and input and output frames rotatable relative to each other about the input shaft. A ratio of angular velocities of the input and output shafts is related to an angle of rotation between the input and output frames.

10 Claims, 10 Drawing Sheets

ENGINE STARTER

TECHNICAL FIELD

This invention relates to a starter and, more particularly, to a starter for use in starting an engine used in a vehicle or the like.

BACKGROUND ART

A conventional starter for use in starting a vehicular engine has been constructed as shown in FIG. 1.

The conventional engine starter 1 shown in FIG. 1 comprises a d.c. motor 2, an over-running clutch assembly 4 slidably mounted on an armature rotary shaft 3, a gear unit 5 for reducing and transmitting the rotating force of the armature rotary shaft 2*a* of the d.c. motor 2 to a clutch outer member 4*a* of the over-running clutch mechanism 4, and a shift lever 8 engaged at its one end with a plunger rod of a solenoid switch assembly 6 which is disposed on one side of the d.c. motor 2 for axially moving the over-running clutch assembly 4 and at its the other end with an annular member 7 mounted to the over-running clutch assembly 4.

However, during the starting of an internal combustion engine, high torque is required at the initial stage and low torque and high speed are required after the initial combustion. With a conventional starter having only a fixed speed changing ratio, more torque is needed at the initial stage of starting and more rotating speed is required after initial combustion. Therefore, a starter employing a belt-type stepless speed changer such as the one disclosed in Japanese Utility Model Laid-Open No. 58-172058 has been proposed.

However, in the starter with the belt-type stepless speed changer as disclosed in the aforementioned Japanese Laid-Open document, a problem of power loss due to slipping is posed and, since the load change is great between the compression stroke and the combustion stroke of the piston particularly in starting the engine, the belt slips easily, resulting in very poor transmission efficiency as compared to an ordinary starter.

DISCLOSURE OF INVENTION

The object of the present invention is to provide a starter having a stepless speed changing mechanism low in power loss and high in efficiency.

A starter of the present invention includes a speed changing mechanism for transmitting rotational force of an electric motor to a pinion gear capable of being brought into or out of engagement with a ring gear of an engine. The speed changing mechanism includes a geared stepless speed changer. A speed reduction ratio is controlled responsive to a load change by means of an input shaft, an output shaft, and input and output frames rotatable relative to each other about the input shaft. A ratio of angular velocities of the input and output shafts is related to an angle of rotation between the input and output frames.

According to the starter of the present invention, when an engine starter switch is closed, the pinion is axially moved until it is brought into engagement with the ring gear of the engine. The rotating force of the electric motor is transmitted to the pinion through the geared stepless speed changer to rotate the ring gear to start the engine. While the load change is large between the compression and combustion strokes of the engine piston, the rotational force of the electric motor is transmitted to the ring gear without a large power loss because the stepless speed changer is of the gear type.

BRIEF DESCRIPTION OF DRAWINGS

The present invention will become more readily apparent from the following detailed description of the preferred embodiment of the present invention taken in conjunction with the accompanying drawings, in which.

BEST MODE FOR CARRYING OUT INVENTION

The starter of the present invention will now be described in conjunction with an embodiment of the present invention shown in the accompanying drawings.

Figure 2:
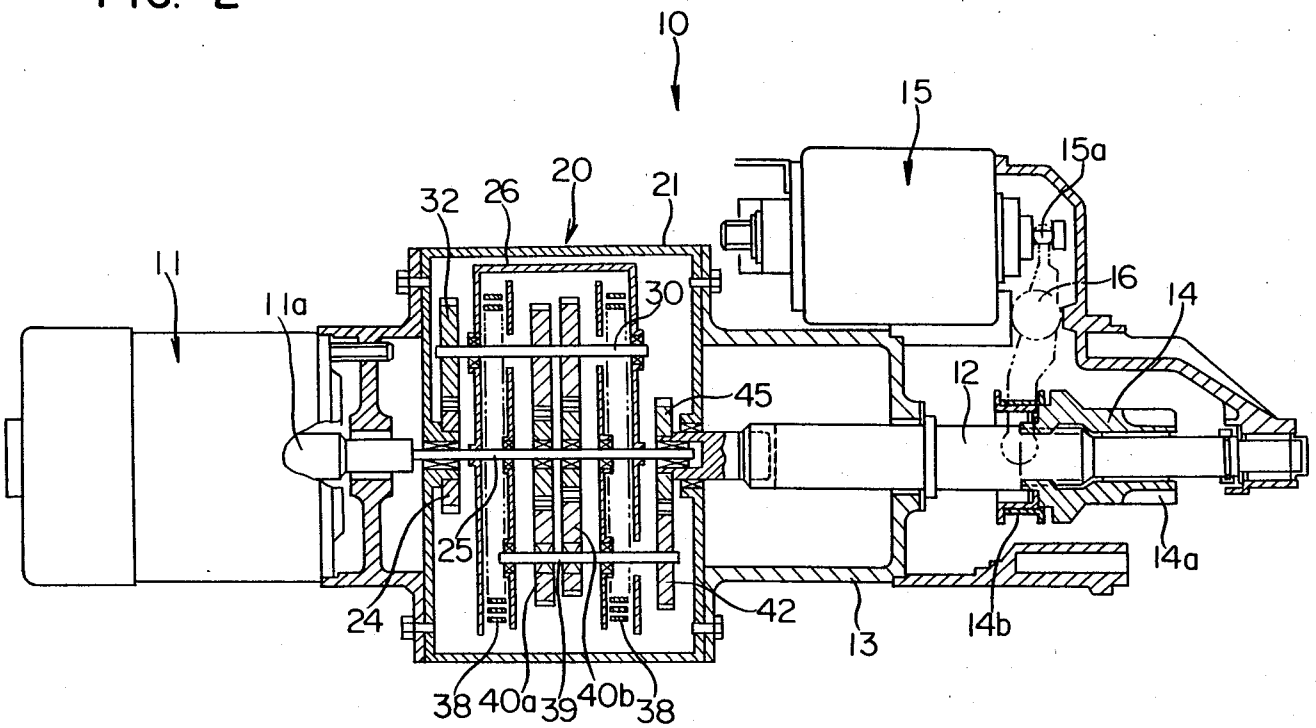
FIG. 2 is a cross sectional view of the starter of one embodiment of the present invention.

FIG. 2 illustrates a starter 10 of one embodiment of the present invention.

The starter 10 of this embodiment comprises a d.c. motor 11, with an output rotary shaft 12 rotatably supported by a machine frame 13 on the front side of the d.c. motor 11 with its central axis common to that of an armature rotary shaft 11*a* of the motor 11. On the outer circumferential portion of the output rotary shaft 12, a cylindrical member 14 is fit to be axially movable and rotatable on the output rotary shaft 12 by being in an engaged state with a helical spline on the outer circumference of the shaft 12. A pinion 14*a* is provided on a circumference of one end of the cylindrical member 14, and an annular member 14*b* is mounted on the other end.

Figure 1:
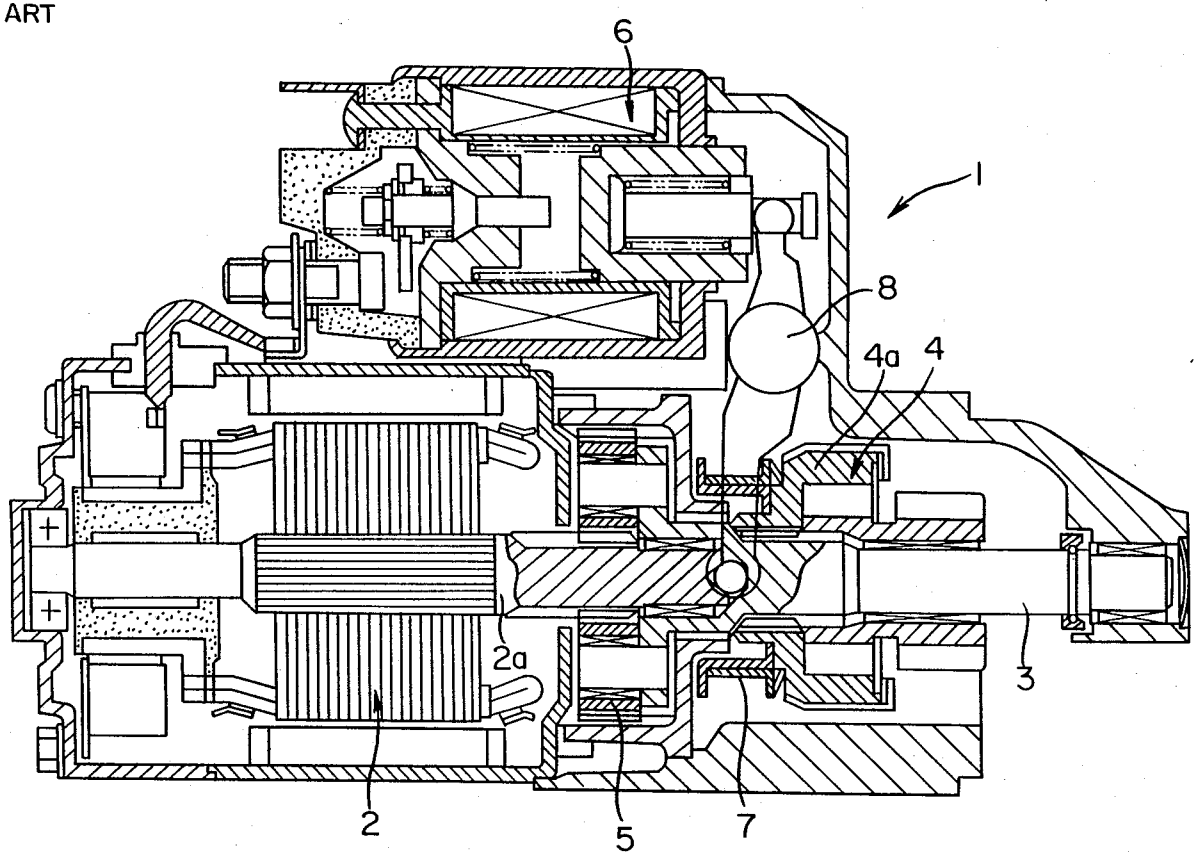
FIG. 1 PRIOR ART
FIG. 1 is a longitudinal sectional view of the conventional engine starter.

At one side of the output rotary shaft 12, a solenoid switch 15 is disposed in order to electrically connect an electric source to the d.c. motor 11 and to axially move the cylindrical member 14 on the output rotary shaft 12. This solenoid switch 15 is the same as that used in the conventional starter illustrated in FIG. 1, one end of a plunger rod 15*a* of the solenoid switch 15 being engaged with one end of a shift lever 16, and one end of the shift lever 16 being engaged with the annular member 14*b* of cylindrical member 14. With this construction, when the solenoid switch 15 is energized, the movement of the plunger rod 15*a* is transmitted to the cylindrical member 14 through the shift lever 16, moving the cylindrical member 14 on the output rotary shaft 12 in the axial direction to the right as seen in FIG. 2, and the pinion 14*a* on one end of the output rotary shaft 12 is brought into engagement with the ring gear (not shown) of the engine to be started.

A speed changing mechanism comprising a geared stepless speed changer 20 is disposed between the d.c. motor 11 and the output rotary shaft 12 as shown in FIG. 2. The geared stepless speed changer 20 has on its input side an armature rotary shaft 11*a* of the d.c. motor 11 and has on its output side the output rotary shaft 12. FIGS. 3, 4, 5 and 6 illustrate in detail one embodiment of the geared stepless speed changer 20 which comprises a casing 21 fixed to machine frame 13 of the starter 10, bearings 22 and 23 supported by the casing 21, an input central gear 24 secured to the casing 21 to always be stationary, an input shaft 25 rotatably supported by the bearing 22 at its one end and directly connected to the armature rotary shaft 11*a*, an input frame 26 secured at its both ends to the input shaft 25 to be rotated as one piece. The input frame 26 supports a pair of bearings 27 and has formed thereon a pair of first rotation limiting holes 28. The speed changer 20 also comprises a first pin 29 supported at both ends by the input frame 26 for supporting a spring or an elastic member 38, and an input planetary shaft 30 rotatably supported by the bearings 27 and having secured thereto input non-circular planetary gears 31*a* and 31*b*. An input planetary gear 32 is fixedly mounted to the input planetary gear shaft 30 and is in mesh with the input central gear 24, and an output frame 33 is rotatably supported on the input shaft 25 through a pair of bearings 34. The output frame 33 supports a pair of bearings 35 and has formed thereon a pair of second rotation limiting holes 36. A second pin 37 for engaging the spring is secured at its opposite ends to the output frame 33. The first pin 29 passes through the second rotation limiting hole 36, and the opposite ends of the second pin 37 pass through the first rotation limiting holes 28. A pair of torsional elastic members 38 which are coil springs in this embodiment are connected between the first pin 29 and the second pin 37 to apply an elastic torque about the input shaft 25 between the input frame 26 and the output frame 33. An output planetary shaft 39 rotatably supported by bearings 35 supports output non-circular planetary gears 40*a* and 40*b* through one way clutch bearings 41, and has an output planetary gear 42 secured on the end thereof. The previously described output shaft 12 is rotatably supported at its one end by means of the bearing 23 and in turn supports one end of the input shaft 25 by means of a bearing 44 mounted therein. An output central gear 45 secured to the output shaft 12 is in mesh with the output planetary gear 42. Non-circular central gears 46*a* and 46*b* are rotatably supported on the input shaft 25 through bearings 47 and are in mesh with the input non-circular planetary gears 31*a* and 31*b* as well as with the output non-circular planetary gears 40*a* and 40*b*, respectively.

Figure 4:
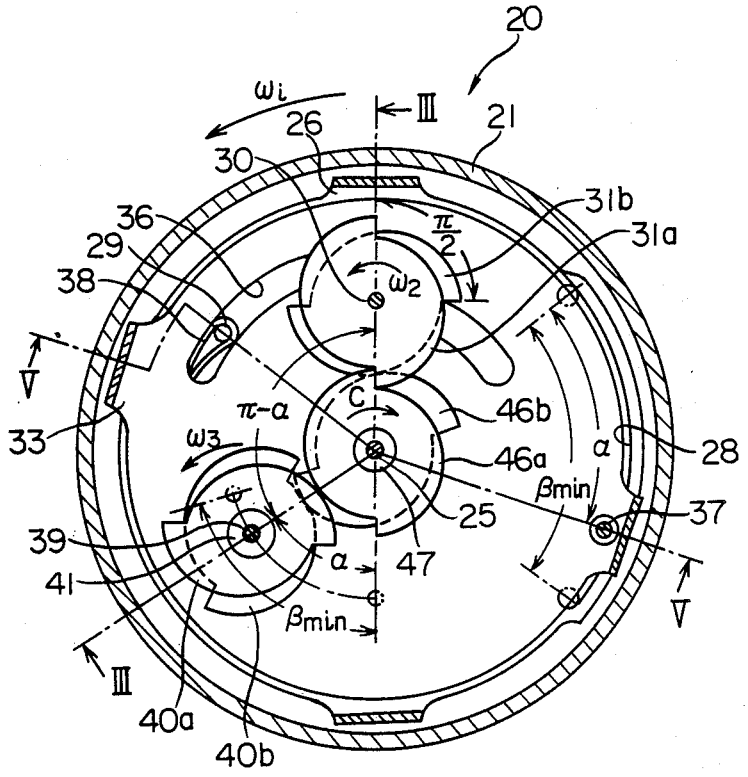
FIG. 4 is a sectional view of the geared steepless speed changer taken along line IV–IV of FIG. 3.
Figure 5:
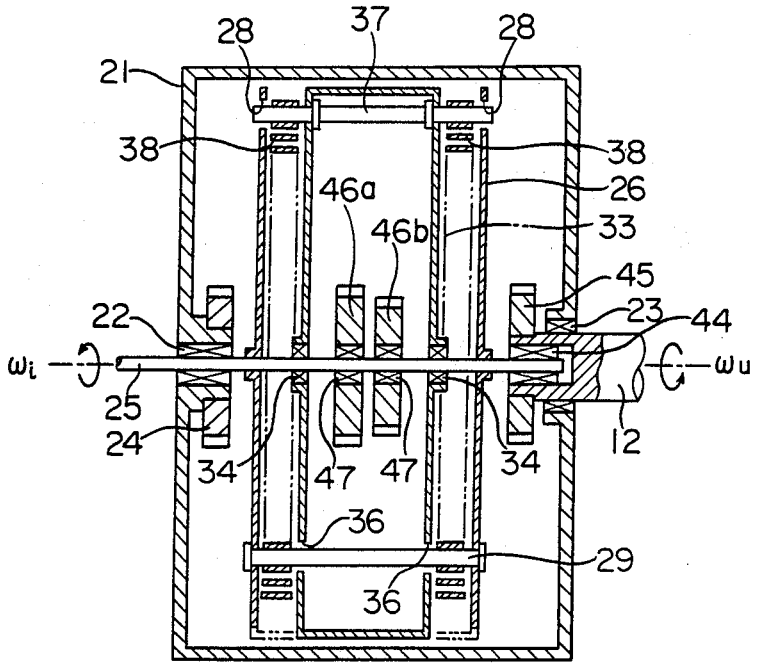
FIG. 5 is a sectional view of the geared stepless speed changer taken along line V—V of FIG. 4.
Figure 6:
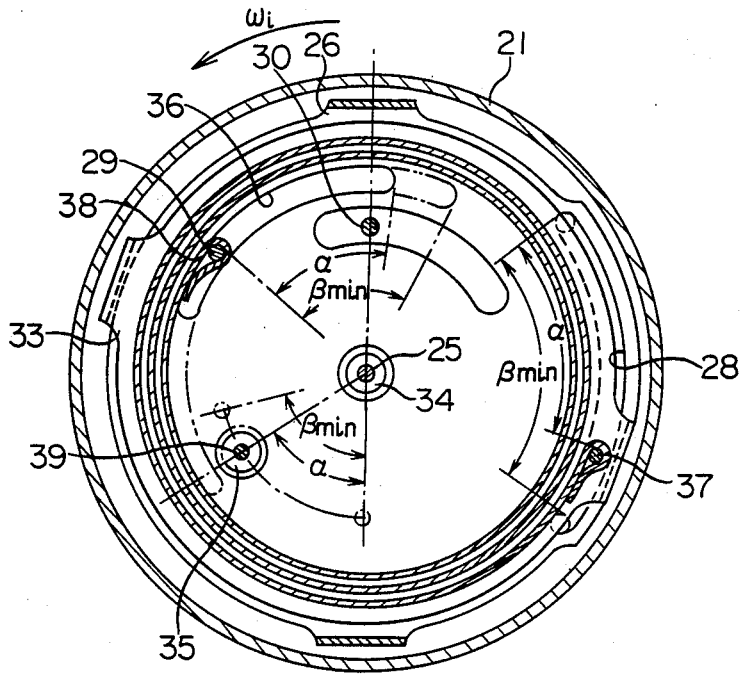
FIG. 6 is a sectional view of the geared stepless speed changer taken along line VI—VI of FIG. 3.

From FIG. 4, it is seen that the input frame 26 and the output frame 33 are arranged in a structure in which they are rotatable relative to each other about the axis of the input shaft 25. In this embodiment, they are rotatable through an angle range corresponding to a range in which the rotational angle $\alpha$ changes from 0 to 0.415 $\pi$ radian. When no external rotating torque except for that from the torsion spring members 38 is applied to the frames 26 and 33, one end of the second rotation limiting hole 36 rests against the first pin 29 to maintain $\alpha=\beta$ min. In this position, the second pin 37 is also positioned at one end of the first rotation limiting hole 28 so that the relative rotational position between the frames 26 and 33 follows the relationship $\alpha=\beta$ min. It is when some external rotational torque is applied between the input frame 26 and the output frame 33 in opposition to the torsional elastic torque from the torsional elastic members 38 that the rotational angle $\alpha$ becomes smaller than $\beta$ min, and the rotational angle $\alpha$ changes in accordance with the external rotational torque and the torque characteristics given in the torsional elastic members 38. When the external rotational torque is greater than the minimum value and smaller than the maximum value of the torsional elastic torque of the torsion elastic members 38, the rotational angle $\alpha$ is $\beta$ min$<\alpha<0$. When the external rotating torque is greater than the maximum value of the torque of the elastic torque of the torsional elastic members 38, the first pin 29 is rotated until it abuts against the other end of the second rotation limiting hole 36, where the condition $\alpha=0$ is established. In this position, the second pin 37 is also rotated until it abuts against the other end of the first rotation limiting hole 28, maintaining the rotational position to be $\alpha=0$.

In the geared stepless speed changer constructed as described above, the input non-circular planetary gears 31*a* and 31*b* as well as the output non-circular planetary gears 40*a* and 40*b* are identical to each other as far as the non-circular teeth shape specifications are concerned. Also, the non-circular teeth shapes of the non-circular central gears 46*a* and 46*b* are identical to each other, and are different from those of the non-circular planetary gears. Therefore, this speed changer employs non-circular gear pairs in which gears having two kinds of non-circular teeth configurations are engaged.

Figure 7:
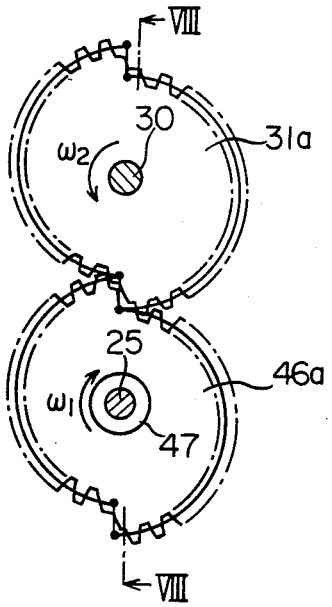
FIG. 7 is a front view showing the non-circular gear pair in the geared stepless speed changer shown in FIG. 4.
Figure 8:
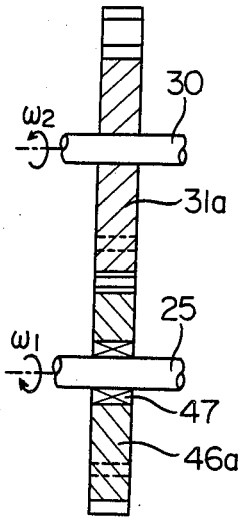
FIG. 8 is a sectional view of the non-circular gear pair taken along line VIII–VIlI of FIG. 7.

FIGS. 7 and 8 illustrate only one set of the previously described non-circular gear pair. In FIGS. 7 and 8, the non-circular central gear 46*a* and the input non-circular planetary gear 31*a* are illustrated, each of which represents a gear having the same teeth shape specification out of the two kinds of specifications. This non-circular gear pair is provided with the characteristics of the non-circular gear disclosed in Japanese Patent Application Nos. 60-106524 and 60-275540. The absolute value $|\omega_2/\omega_1|$ of the ratio of the angular velocity $\omega_2$ of the input non-circular planetary gear 31*a* relative to the angular velocity $\omega_1$ of the non-circular central gear 46*a* varies in accordance with the variation characteristics of a logarithmic function relative to the angular displacement $\theta$ within a predetermined range of the angular displacement $\theta$. This variation characteristic $F(\theta)$ is determined by the following logarithmic function:

$$F(\theta)=|\omega_2/\omega_1|=e^{-K\theta}F(0)$$

where F(0) is the reference angular velocity ratio, and K is an angular velocity modulation factor for always providing a positive value, both of which can be suitably selected during the designing of the application. By the way, in the embodiment shown in FIG. 7, the range of the angular displacement $\theta$ is $0 \sim \pi$, $F(0)=1.386$ and $K=0.2206$ radian. In the equation, e is the base of the natural log.

While each of the non-circular gears shown in FIG. 7 has formed on its entire periphery involute teeth such as partly shown in the figure, since the relationships of the angular velocity or the transmitted torque of the engaged gears can be explained by the engagement pitch curves, the gears in FIG. 7 and other figures are illustrated only by pitch curves with the illustration of the teeth shape being partly or entirely omitted.

Figure 9:
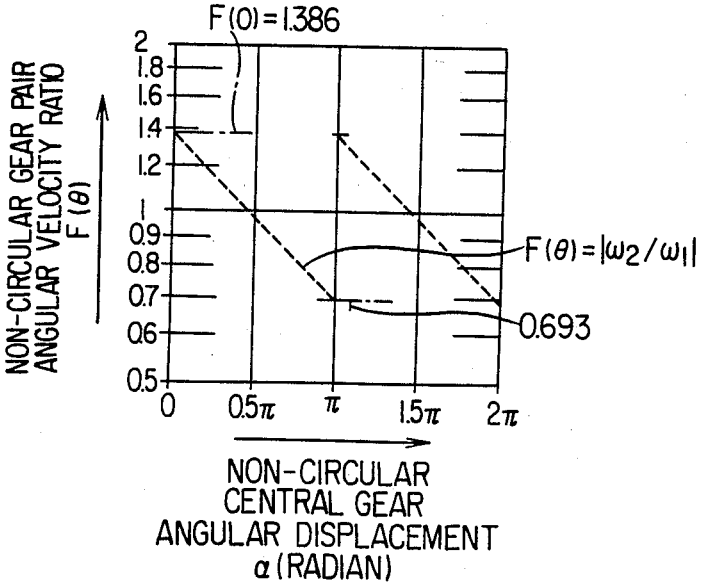
FIG. 9 is a graph concerning the angular velocity ratio of the non-circular gear pair of FIGS. 7 and 8.
Figure 10:
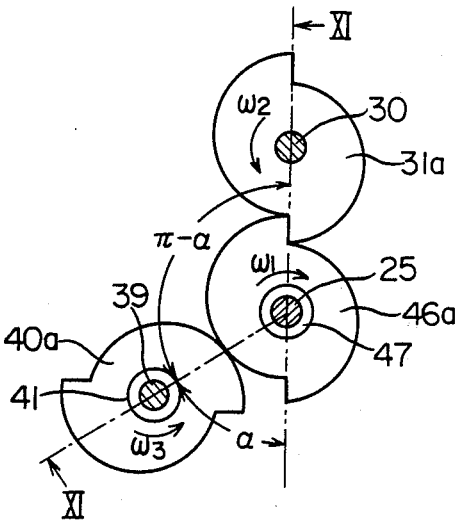
FIG. 10 is a front view showing the elemental mechanism constituting the angular velocity modulation function of the geared stepless speed changer.
Figure 11:
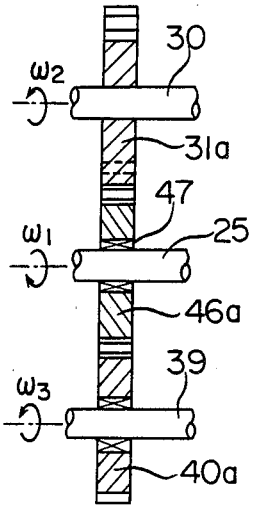
FIG. 11 is a sectional view showing the elemental mechanism taken along line XI—XI of FIG. 10.

The description will now be made as to the peculiar angular velocity modulating function which can be induced from the features of the ratios of the angular velocities of the above-described non-circular gear pair. FIGS. 10 and 11 are a front view and a sectional side view, respectively, of the mechanism having the function of angular modulation in the device illustrated and described in conjunction with FIGS. 3 to 6. In FIGS. 10 and 11, the relationship in which an output non-circular planetary gear 40*a* is added to the non-circular gear pair which has already been described in conjunction with FIGS. 7 and 8 is illustrated. The gear pair in which the non-circular central gear 46*a* and the input non-circular planetary gear 31*a* are in mesh with each other will be referred to as a primary angular velocity modulation means, and the gear pair in which the non-circular central gear 46*a* and the output non-circular planetary gear 40*a* are in mesh with each other will be referred to as a secondary angular velocity modulation means. The primary angular velocity modulation means is a means for determining the ratio of the angular velocity $\omega_2$ of the input planetary shaft 30 (to which the input non-circular planetary gear 31*a* is secured) relative to the angular velocity $\omega_1$ of the non-circular central gear 46*a*. This ratio, $\omega_2/\omega_1$ will be referred to as a primary angular velocity ratio. The secondary angular velocity modulation means is a means for determining the ratio of the angular velocity $\omega_3$ of the output planetary shaft 39, which is driven by the output non-circular planetary gear 40*a* through the bearing 41 with a one-way clutch function, to the above angular velocity $\omega_1$. This ratio, $\omega_3/\omega_1$, will be referred to as a secondary angular velocity ratio. Similar to the primary angular velocity modulation means which has been explained in conjunction with FIGS. 7 to 9, the secondary angular velocity modulation means itself can also be explained by FIGS. 7 to 9. However, it should be noted that, as shown in FIG. 10, the output planetary shaft 39 is positioned at the central angle of $\pi-\alpha$ radians relative to the input planetary shaft 30 about the input shaft 25. Since the meshing relation of the output non-circular planetary gear 40*a* with respect to the non-circular central gear 46*a* returns back to the same relationship at every central angle of radians around the gear 46*a*, $\pi-\alpha$ radians is substantially an equivalent to a central angle of $-\alpha$ radians. Therefore, when the primary angular velocity modulation means is in an engaged state at an angular displacement $\theta$ of the non-circular central gear 46, the secondary angular velocity modulation means is in an engaged state at the above angular displacement $\theta-\alpha$. Under these conditions, when the primary angular velocity ratio $|\omega_2/\omega_1|$ is as previously explained a value expressed by a logarithmic equation $e^{-K\theta}F(0)$, the secondary angular velocity ratio $|\omega_3/\omega_1|$ is a value expressed by a logarithmic equation $e^{-K(\theta-\alpha)}F(0)$. Under these conditions, the ratio $\omega_3/\omega_2$ of the angular velocity of the output planetary shaft 39 relative to the angular velocity of the input planetary shaft 30 can be considered as a ratio of the secondary angular velocity relative to the primary angular velocity, so that the angular displacement $\theta$ and the reference angular velocity ratio F(0) are cancelled out by each other to become a value as expressed by a logarithmic equation $e^{K\alpha}$ which consists of the above factor K and the rotational angle $\alpha$. The above equation exhibits the elemental mechanism for effecting the angular modulation provided in the stepless speed changer. This elemental mechanism is a non-circular gear mechanism as shown in FIGS. 10 and 11 which is a combination of a single non-circular central gear and two non-circular planetary gears. In the device shown in FIGS. 3 to 6, two sets of the above element pairs are employed, and the first of the pairs is constructed by three non-circular gears 46*a*, 31*a* and 40*a*, shown in FIGS. 10 and 11, and the second of the pairs is constructed by the non-circular central gear 46*b*, the input non-circular planetary gear 31*b* and the output non-circular planetary gear 40*b*.

In this geared stepless speed changer, an elemental mechanism having an angular velocity modulation function in a logarithmic function is provided as described above, the stepless speed changer having a structure in which a plurality of sets of the elemental mechanism are combined so that the value of the rotational angle $\alpha$ can be varied by manual or automatic control, and a one way clutch function is additionally provided for selectively taking out a particular value from the repetitive change patterns of the angular velocity. That is, as has already been described, the structure in which the input frame 26 and the output frame 33 are relatively rotatable is a variable control means for $\alpha$. This variable control means functions in common to the first and the second sets of a plurality of elemental mechanisms. The torsional elastic member 38 having a predetermined elastic property is disposed between the frames 26 and 33 to automatically control the rotational angle $\alpha$.

As shown in FIG. 4, a rotational phase angle difference of $\pi/2$ radians is provided to the first and the second input non-circular planetary gears 31*a* and 31*b* secured to the input planetary shaft 30. When the value of the angular velocity ratio $\omega_3/\omega_2$ by the first set elemental mechanism is expressed by the function $G_1(\theta)$, and when the value of the angular velocity ratio $\omega_3/\omega_2$ by the second set elemental mechanism is expressed by the function $G_2(\theta)$, then the relation $G_2(\theta)=G_1(\theta+\beta)$ is maintained. In the above equation, $\beta$ is the above rotational phase differential angle $\pi/2$ radians on the input planetary shaft 30 substituted by the rotational phase differential angle between the non-circular central gears 46*a* and 46*b* on the input shaft 25, the value of which is given by a function of the angular displacement $\theta$ of the input shaft 25. In the embodiment illustrated in FIG. 3, the minimum value $\beta$ min of $\beta$ is 0.145 $\pi$ radians. Thus, by utilizing a combination of the plurality of sets of the elemental mechanism, the angular velocity ratio $\omega_3/\omega_2$ can be made continuous.

Means for selecting only a particular value out of a plurality of the angular velocity variable patterns is realized by the one way clutch function. In FIGS. 3 to 6, when the $\omega_2$ reference angular velocity ratio appearing on the first and the second set of the output non-circular planetary gears 40*a* and 40*b* is different according to the value of $\theta$, the bearing 41 with one way clutch function selects only one of the angular velocities according to either one of the angular velocity ratios to be transmitted to the output shaft 39. As for the direction of transmission, since, in the illustrated direction of rotation, the rotating force is transmitted only from the output non-circular planetary gears 40*a* and 40*b* to the output planetary shaft 39, the arrangement is such that only the greater value of the angular velocity ratio contributes to the driving of the output planetary shaft 39 and the lower value of the angular velocity ratio does not contribute to the driving of the output planetary shaft 39 by the one way clutch function of the bearing 41.

The description heretofore has been made mainly in connection with the angular velocity modulation function related to the angular velocity ratio $\omega_3/\omega_2$ between the input planetary shaft 30 and the output planetary shaft 39. This can be considered to be an imaginary mechanism in which the input planetary gear 32, the input central gear 24, the output planetary gear 42 and the output central gear 45 are eliminated from the arrangement shown in FIGS. 3 to 6 so that the angular velocity of the rotational component of the input planetary shaft 30 and the output planetary shaft 39 alone may be considered. From this, based on the previously described angular velocity ratio $\omega_3/\omega_2$, and within the rotation angle range of from 0 to $0.415\pi$ radians, the stepless intermediate angular velocity ratio corresponding to the stepless intermediate set value of the rotation angle $\alpha$ appears from the state in which the input planetary shaft 30 and the output planetary shaft 39 rotate at equal angular velocity ($\alpha=0$) to the state in which the angular velocity ratio becomes 1.333 ($\alpha=0.415\pi$).

In the geared stepless speed changer of the structure illustrated in FIGS. 3 to 6, the relationship between the angular velocities of the input shaft 25 and the output shaft 12 can be determined by conversion from the characteristics of the angular velocity ratio $\omega_3/\omega_2$ since this speed changer is arranged in the form of a planetary gear unit. That is, the characteristics of the angular velocity ratio $\omega_3/\omega_2$ is the angular velocity ratio with a fixed carrier (with the fixed frame in this example) which is often used in computing the rotational speed of a planetary gear mechanism. In the example shown in FIGS. 3 to 6, the ratio of the number of teeth between the input central gear 24 and the input planetary gear 32, and the ratio of the number of the gear teeth between the output central gear 45 and the output planetary gear 42 can be set at will. While these teeth number ratios are effective and important as means for fixedly matching the absolute value of the rotating speed ratio between the input and the output shafts of the stepless speed changer, and have an influence as a constant concerning the transmission torque and the torsional elastic characteristics of the torsional elastic member 38 upon setting the characteristics of automatic controlling, these ratios do not affect the essential part of the angular velocity changing function of the stepless speed changer. In the speed changer shown in FIG. 3, the teeth number ratio between the input central gear 24 and the input planetary gear 32 is 1:1, and the teeth number ratio between the output central gear 45 and the output planetary gear 42 is also 1:1. The ratio of the output angular velocity $\omega u$ to the input shaft angular velocity $\omega i$ can be obtained from the following comparison table of angular velocity of the various component elements which was prepared according to a typical method.

Comparison Table of Angular Velocity of Component Elements (Radians/Sec)

| Condition | Components: Input Central Gear | Input Planetary Gear | Input Shaft | Output Planetary Gear | Output Shaft Gear |
|---|---|---|---|---|---|
| Input Shaft Fixed | $-1$ | $+1$ | 0 | $+e^{K\alpha}$ | $-e^{K\alpha}$ |
| Mechanism Fixed | $+1$ | $+1$ | $+1$ | $+1$ | $+1$ |
| Added Net Value | 0 | $+2$ | $+1$ | $+e^{K\alpha}+1$ | $+(e^{K\alpha}-1)$ |
| | | | ↑ $\omega i$ | | ↑ $\omega u$ |

Figure 12:
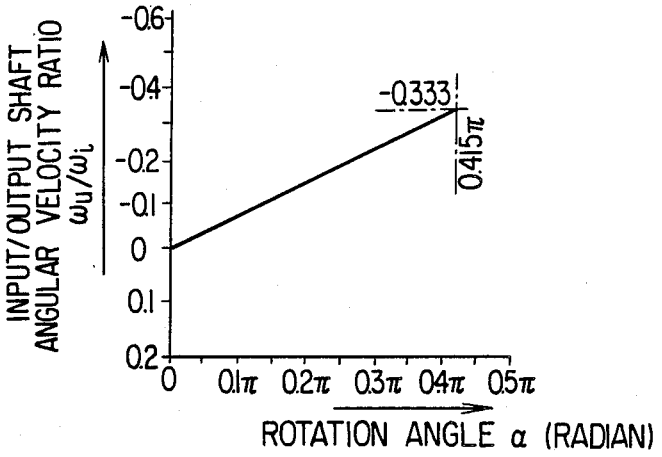
FIG. 12 is a graph showing the angular velocity ratio of the input and the output shafts of the apparatus shown in FIG. 3.

That is, the angular velocity ratio $\omega u/\omega i$ between the angular velocities of the input and output shafts of the arrangement shown in FIGS. 3 to 6 is determined to be $-(e^{K\alpha}-1)$ as a function of the rotation angle $\alpha$ to exhibit the characteristics as shown in FIG. 12. Within the range of from 0 to $0.415\ \pi$ radian of rotation angle $\alpha$ on the abscissa, the value $\omega u/\omega i$ can be continuously varied in a stepless manner between the state in which the angular velocity $\omega u$ of the output shaft 43 is 0 irrespective of the value of the angular velocity $\omega i$ of the input shaft 25 ($\alpha=0$) and the state in which an angular velocity ratio of $-0.333$ times appears ($\alpha=0.415\ \pi$ Radians).

In FIGS. 3 to 6, $\omega i$ represents the angular velocity of the input shaft 25, the input frame 26, the output frame 33 and the torsional elastic member 38 and the rotation component angular velocity of the input planetary shaft 30 and the output planetary shaft 39. $\omega_2$ represents the rotation component angular velocity of the input planetary shaft 30, the input non-circular planetary gears 31*a* and 31*b* and the input planetary gear 32. $\omega_3$ represents the rotation component angular velocity of the output planetary shaft 39 and the output planetary gear 42, and $\omega u$ represents the angular velocity of the output shaft 12 and the output central gear 45. Also, C designates the direction of rotation of the rotation component of the non-circular central gear 46*a* and 46*b*.

Figure 3:
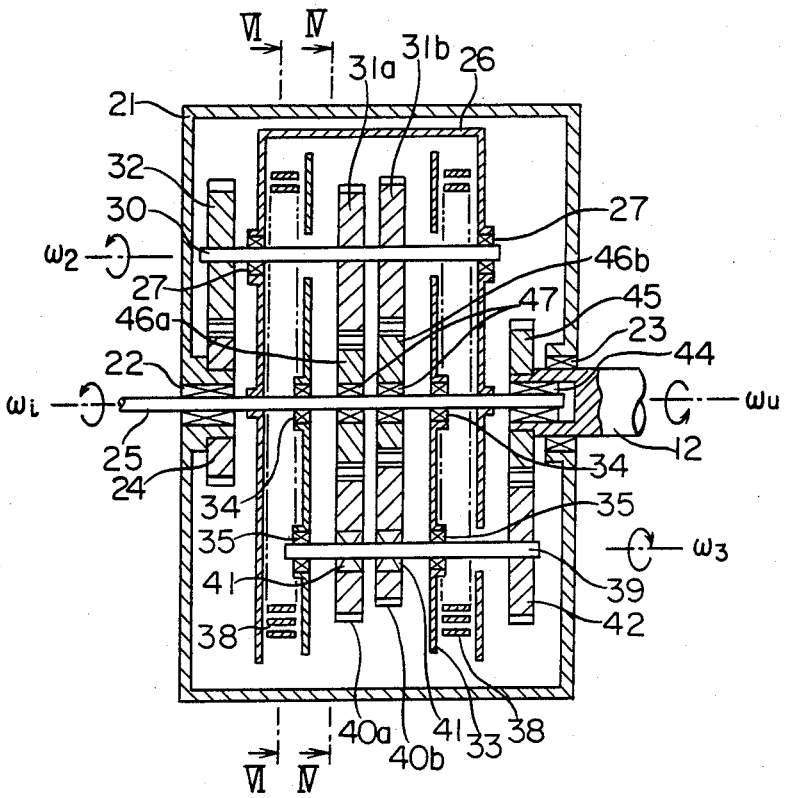
FIG. 3 is a sectional view showing the geared stepless speed changer constituting the starter.
Figure 13:
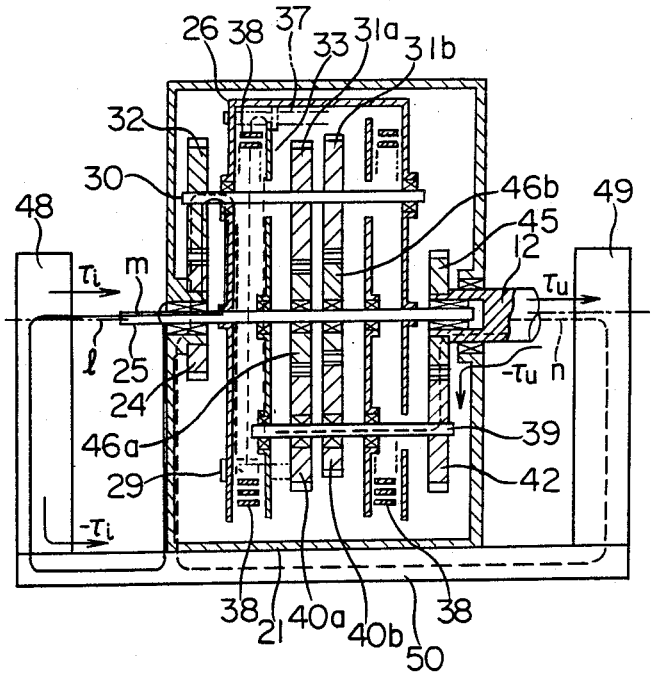
FIG. 13 is a sectional view of the geared stepless speed changer showing the torque equilibrium during operation in which the geared stepless speed changer is incorporated between the d.c. motor and the output rotary shaft.

The automatic control of the rotation angle $\alpha$ will now be described. FIG. 13 is an explanatory diagram in connection with the torque equilibrium in the state in which the device illustrated in FIG. 3 is transmitting the power from the d.c. motor 11 to the load, i.e., the output rotary shaft 12. The reference numeral 48 designates an input side, 49 designates an output side, 50 designates a common base on which the above components are fixedly mounted, the straight line shown by l is a common axis of rotation of the components, $\tau i$ and $\tau u$ are an input and an output torque of this device in terms of the common axis of rotation, closed curves m and n are curves along which dynamic equilibriums are maintained with respect to the input torque $\tau i$ and the output torque $\tau u$. When the input side 48 drives the input shaft 25 by the torque $\tau i$, a reaction torque $-\tau i$ which balances the torque $\tau$ is also applied to the common base 50. These action and reaction torques are in equilibrium within the closed curve m extending through the input frame 26, the input planetary shaft 30, the input planetary gear 32, the input central gear 24 and the casing 21.

On the other hand, when the output shaft 12 drives the output side 49 by the torque $\tau u$, a reaction torque $-\tau u$ which balances the torque $\tau u$ is applied to the output frame 33 through the output central gear 45, the output planetary gear 42 and the output planetary shaft 39. The torque $\tau u$ applied to the output side 49 acts on the input frame 26 from the common base 50 through the casing 21, the input central gear 24, the input planetary gear 32 and the input planetary shaft 30. Thus, a rotation torque corresponding to the output torque $\tau u$ acts between the input frame 26 and the output frame 33, and the torsional elastic torque of the torsion elastic member 38 mounted between the input and the output frames eventually balances the output torque $\tau u$, resulting in an equilibrium of the action and the reaction torques within the closed curve n. The rotation angle $\alpha$ is automatically controlled by the output torque $\tau u$, and its value is determined by the characteristics of the torsional elastic torque which can be arbitrarily given in the torsional elastic member 38.

Figure 14:
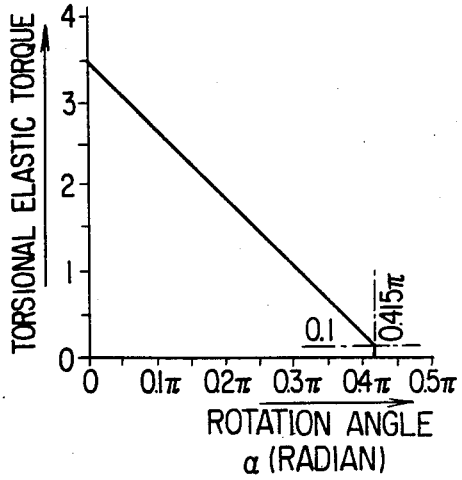
FIG. 14 is a characteristic diagram of the torsional elastic torque of the torsional elastic member shown in FIG. 3.
Figure 15:
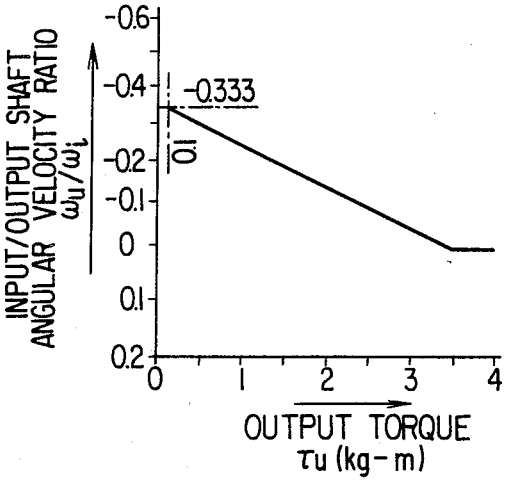
FIG. 15 is a curve showing the automatic control characteristic of the angular velocity ratio of the input and the output shafts by the output torque of the apparatus shown in FIG. 3.

FIG. 14 is a graph showing one example of the varying characteristics in terms of the rotation angle $\alpha$ of the torsional elastic torque provided in the torsional elastic member 38. FIG. 15 is characteristic graphs of the angular velocity ratio between the input and output shafts similar to that shown in FIG. 12, but showing the automatic control characteristics of the angular velocity ratio of the input and output shafts in accordance with the value of the output torque. This is the actual characteristic curve showing the stepless speed changing function of the apparatus shown in FIGS. 3 to 6 by the dynamic function of the external connection ends which are the input and the output shafts. The output torque on the abscissa is the load torque applied to the pinion from the ring gear of the engine which is driven by the apparatus of the present invention, exhibiting that the angular velocity ratio of the input and the output shafts is continuously steplessly controlled in response to the varying load torque. In the illustrated embodiment, when the load torque equals or exceeds 3.5 kg-m, the angular velocity $\omega u$ of the output shaft is 0 irrespective of the value of the angular velocity $\omega_1$ of the input shaft.

While the torsional elastic member 38 is in the form of a coil spring in the heretofore-described arrangement, it should not be restricted to a coil spring, but another suitable elastic single member or an elastic member assembly applying a torsional elastic torque to the input frame and the output frame may equally be employed. Also, while two elastic members 38 are used in the above embodiment, the number of elastic members is not limited.

Further, as for the configuration of the input frame 26 and the output frame 33 in the previously described arrangement, they may be of a different shape and equally applicable as long as they function similarly to those previously described such as the function of supporting the input planetary shaft 30 or the output planetary shaft 39.

Also, the first and the second spring stopper pins and the first and the second rotation limiting holes are used for limiting the rotation angle $\alpha$ of the input frame 26 and the output frame 33 in the above embodiment, a similar advantageous effect can be obtained by selecting another structure from numerous known structures for limiting the rotation angle of two rotating members.

Further, although the non-circular gears used in the geared stepless speed changer 20 are those shown in FIG. 7 in the above embodiment, this is only one example. The non-circular gear configuration effective for achieving the object of the present invention includes the one capable of constructing an angular velocity modulation means disclosed in Japanese Patent application No. 61-11305, and the essential requirement of the configuration is those such as disclosed in Japanese Patent Application Nos. 60-106524 and 60-275540 and all of them are effective.

As has been described, according to the geared stepless speed changer, the stepless mechanism for controlling the input and the output angular velocity in accordance with the load torque of the output shaft can be constructed by a gear unit. Since this control is both the direct control and the internal control as mentioned above, it is provided with perfect mechanical automatic control which still being of a simple structure and it also can be provided with a function for stably operating the control state in which the input and the output shaft angular velocity ratios are 0. Thus, the geared stepless speed changer of the present invention, in which the advantages of the non-frictional power transmission is fully utilized and in which the automatic control function is contained, provides a high transmission efficiency.

As has been described, according to the starter of the present invention, a speed changer unit comprising a geared stepless speed changer is disposed within the transmission path for transmitting the power of the d.c. motor to the output rotary shaft, so that the rotation can be efficiently transmitted to the output rotary shaft with less power loss even upon a great load change during the piston compression stroke or combustion stroke.

We claim:

1. A starter comprising a speed changing mechanism connected to an electric motor to receive rotational force therefrom;

a pinion gear connected to said speed changing mechanism to receive rotational force of the electric motor therefrom; and means for bringing said pinion gear into or out of engagement with a ring gear of an engine wherein said speed changing mechanism comprises a geared stepless speed changer including speed reduction ratio control means operating in response to a load change and wherein said speed reduction ratio control means includes an input shaft, an output shaft, and input and output frames rotatable relative to each other about the input shaft, a ratio of output angular velocity of the output shaft to input angular velocity of the input shaft being related to an angle of rotation between the input and output frames.

2. A starter as claimed in claim 1, wherein said geared stepless speed changer further includes a unidirectional clutch.

3. A starter as claimed in claim 1 wherein said speed reduction ratio control means includes a non-circular central gear and two non-circular planetary gears which are in mesh with the central gear.

4. A starter as claimed in claim 3 wherein the planetary gears include an input gear and an output gear.

5. A starter as claimed in claim 1 wherein said speed reduction ratio control means includes first and second non-circular central gears disposed on the input shaft, first and second input non-circular planetary gears which are in mesh, respectively, with the first and second central gears, and first and second output non-circular planetary gears which are in mesh, respectively with the first and second central gears.

6. A starter as claimed in claim 1 wherein the input frame is secured to the input shaft to be rotated as one piece.

7. A starter as claimed in claim 1 wherein the output frame is rotatably supported on the input shaft through a pair of bearings.

8. A starter as claimed in claim 1 further comprising automatic control means for varying the angle of rotation between the input and output frames.

9. A starter as claimed in claim 1 further comprising a torsional elastic member connected between the input and output frames to apply an elastic torque about the input shaft between the input and output frames.

10. A starter as claimed in claim 1 wherein the angular velocity of the output shaft $\omega u$, the input angular velocity of the input shaft $\omega i$, an angular velocity modulation factor K, and the angle of rotation between the input and output frames $\alpha$ are related according to the following equation:

$$\omega_u/\omega_i = -(e^{k\alpha} - 1).$$

* * * * *